US006165037A

United States Patent [19]

Van Zant

[11] Patent Number: 6,165,037

[45] Date of Patent: Dec. 26, 2000

[54] ILLUMINATED TOY FOR NIGHT USE BY CHILDREN

[75] Inventor: Dawn L. Van Zant, Delta/Tsawwassen, Canada

[73] Assignee: WildHeart Ranch, Inc., Points Roberts, Wash.

[21] Appl. No.: 09/132,795

[22] Filed: Aug. 13, 1998

[51] Int. Cl.[7] ..... A63H 33/22

[52] U.S. Cl. ..... 446/219; 446/485; 446/369

[58] Field of Search ..... 446/219, 485, 446/297, 394, 34, 369, 385

[56] References Cited

U.S. PATENT DOCUMENTS

| | | | |
|---|---|---|---|
| 2,647,222 | 7/1953 | Nieset | 446/485 |
| 4,778,428 | 10/1988 | Wield | 446/485 |
| 5,114,376 | 5/1992 | Copley et al. | 446/485 |
| 5,672,090 | 9/1997 | Liu | 446/485 |
| 5,720,651 | 2/1998 | Chien | 446/34 |
| 5,791,965 | 8/1998 | Kim | 446/219 |
| 5,830,034 | 11/1998 | Ciechanowski et al. | 446/485 |

*Primary Examiner*—Sam Rimell

*Attorney, Agent, or Firm*—Lackenbach Siegel Marzullo Aronson & Greenspan, P.C.

[57] ABSTRACT

A toy, preferably a plush toy, includes a main body and an electroluminescent display panel arranged on and forming a surface portion of the main body. When the plush toy is a toy pony, the electroluminescent display panel is placed, for example, on the blaze on the pony's face. The power source is arranged within the main body and a first ON switch is placed within one front hoof of the pony while a second OFF switch is placed within the other front hoof of the pony. The hooves are soft and deformable so that they can be compressed when squeezed to selectively actuate one of the switches. In this way, application of power to the electroluminescent panel by squeezing of the ON hoof energizes the panel and causes it to generate illumination in the region of the toy. While the OFF switch can be manually squeezed to de-energize the electroluminescent panel, the toy is preferably provided with a timing circuit for automatically de-energizing the electroluminescent panel after a predetermined period, such as 30 minutes.

20 Claims, 2 Drawing Sheets

ILLUMINATED TOY FOR NIGHT USE BY CHILDREN

BACKGROUND OF THE INVENTION

1. Field of the Invention

This invention generally relates to toys and, more particularly, to an illuminated toy for night use by children.

2. Description of the Prior Art

Many people, particularly young children, are very frightened of the dark. In fact, some are so frightened of the dark that they have nightmares about it. This is one of the reasons why many parents leave a night light on in a child's room so that when the child wakes during the night, the room is not totally dark. However, when a child always has a night light in the room, the child may become dependent on that night light and never overcome his or her fear of total darkness. Under certain circumstances, some parents may want to wean the child off dependency on a night light by gradually or selectively exposing the child to darkness during the night, either to have the child overcome this fear and/or because of the belief that the night light may be a distraction and interfere with the child's sleeping habits or the child's quality of sleep. Of course, most night lights are in the nature of small fixtures that simply plug into a wall outlet and remain on all the time while plugged in. While some of these lights include light sensors to turn the night light off as soon as daylight arrives and ambient light is incident on the light sensor, all night lights invariably remain on the entire night while plugged into the wall outlet.

SUMMARY OF THE INVENTION

Accordingly, it is an object of the present invention to provide a device, particularly for young children, that overcomes the disadvantages inherent with existing night lights.

It is another object of the present invention to provide an illuminated toy for night use by children which can be easily and selectively turned on and off by a young child any time during the night and while in total darkness.

It is still another object of the present invention to provide an illuminated toy which can serve as an aid to overcome a child's fear of darkness and which promotes the elimination of nightmares with regard thereto.

It is yet another object of the present invention to provide an illuminated toy for night use by children which can serve as a "companion" to the child during the night and provide the child with greater security and comfort when sleeping in the darkness.

It is a further object of the present invention to provide an illuminated toy for night use by children which the child can activate at will and remains activated for a predetermined given period of time to allow the child to fall asleep and automatically turns off, promoting the elimination in the child of his or her fears of darkness.

In order to achieve the above objects, as well as others which will become evident hereinafter, a toy in accordance with the present invention includes a main body. An electroluminescent display panel is provided which is arranged on and forms a surface portion of said main body. A power source is provided arranged within said main body. Switch means is made accessible to the user for selectively applying and removing power from said power source to said electroluminescent display panel. In this manner, application of power to said electroluminescent panel energizes said panel and causes said panel to illuminate the general region of the toy. Preferably, the toy is one that can become endeared to a child, such as a plush toy, which has at least portions thereof which are soft and deformable, said switch means being placed within such portions so that the child may selectively turn the toy on and off by compressing or squeezing such deformable portion or portions.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of preferred embodiments in which.

DESCRIPTION OF THE PREFERRED EMBODIMENTS

Figure 1:
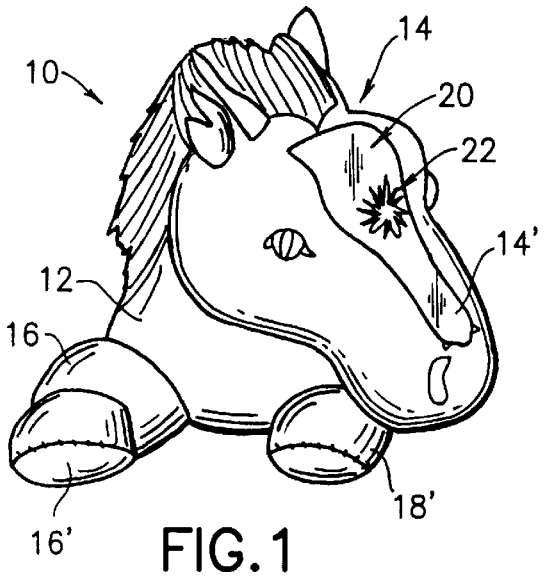
FIG. 1 is a front elevational view of a plush toy in the form of a pony in accordance with the present invention, illustrating the illuminated portion arranged on the blaze on the face of the pony.

Referring now specifically to the drawings, in which identical or similar parts are designated by the same reference units throughout, and first referring to FIG. 1, a plush toy in the form of a pony is identified by the reference numeral 10 in accordance with the invention. The size of the pony 10 is not critical, although it should be sufficiently small so that it can be placed in a crib or bed of a child and large enough to have a surface area to support an electroluminescent panel, to be described, which can generate sufficient light to provide comfort to the child. By way of example only, the pony 10 may be 8 inches high, 14.5 inches long and 9.25 inches wide.

While the presently preferred embodiment of the invention is in the nature of a plush toy, it will be evident that the invention can also be incorporated into a wide variety of other toys that do not necessarily have to be plush, in which case slight modifications may need to be made, as to be described.

The pony 10, being a plush toy, includes at least portions thereof which are soft and deformable so that they can be compressed when squeezed. The pony 10 includes a main body 12, a head 14 and front legs 16, 18 having hooves 16', 18', respectively, as shown. The front hooves 16', 18' are soft and compressible, although it will be evident that other portions of the pony 10 may have similar characteristics or properties and may be used for purposes to be described, instead of the hooves.

In accordance with the present invention, an electroluminescent panel 20 is secured to the blaze 14' on the face of the pony. In order to maximize the size of the electroluminescent panel 20, it preferably extends over the entire blaze region, as shown in FIG. 1.

The electroluminescent panel 20 is preferably soft and flexible. The specific construction of the electroluminescent panel is not critical, as long as it is flexible and generates sufficient light when energized. In the presently preferred embodiment, the actual electroluminescent element 21 is housed within a pouch 22, both the pouch and the electroluminescent unit generally having the desired shapes to conform to the size and shape of the pony's blaze 14'.

Figure 2:
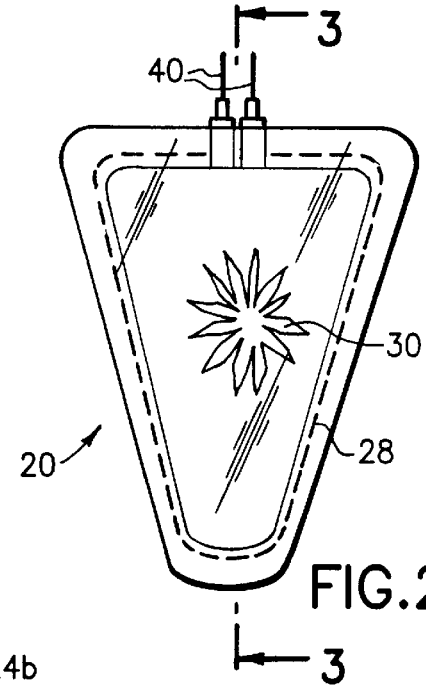
FIG. 2 is a front elevational view of the electroluminescent panel applied to the plush pony shown in FIG. 1.
Figure 3:
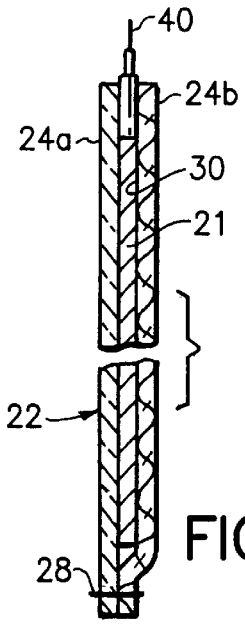
FIG. 3 is a cross sectional view of the electroluminescent panel shown in FIG. 2, taken along line 3—3.

As best illustrated in FIG. 3, the pouch 22 is preferably formed of two sheets or layers 24*a*, 24*b* of clear PVC with the electroluminescent element 21 sandwiched therebetween. Once so assembled, the two exterior panels 24*a*, 24*b*, which are slightly oversized to extend beyond the perimeter of the electroluminescent element 21, are stitched together or otherwise fastened by any suitable means at 28 to enclose and secure the electroluminescent element 21 within the pouch 22 and preferably seal the same to protect it from fluids and other contaminants. Also, since electroluminescent panels generally generate substantially uniform illumination over their entire surface area, the top clear or transparent panel 24*a* of the pouch 22 is preferably at least partially provided with opaque art work 30 which becomes visible when the electroluminescent element 21 is energized and serves as a backlight or background for the imprinted art. The imprinted art 30 can, clearly, be in color and can be any art that will be aesthetically pleasing to a child and such art may be silkscreened on the front panel 24*b*, preferably on the interior surface thereof juxtaposed against the electroluminescent element 21 so as to protect the art work from abrasive forces, liquids and other contaminants. As suggested, the art work can take any form and, in FIGS. 1 and 2, it is shown to be in the form of a star or sunburst, but may also be, for example, a comet, a moonbeam, cartoon characters or any other pleasing design.

The electroluminescent element 21 may be a suitable element which is thin, flexible and provides desired light intensity. For example, reference is made to U.S. Pat. Nos. 4,342,945 and 4,670,690 for thin film electroluminescent display panels. Another electroluminescent display is disclosed in U.S. Pat. No. 4,734,617. Other patents disclosing electroluminescent display devices include U.S. Pat. Nos. 3,793,628 and 4,814,668. A thin-film electroluminescent display and method of fabricating the same is disclosed in U.S. Pat. No. 4,691,738. In U.S. Pat. No. 5,585,695, a thin-film electroluminescent display module is disclosed which is sealed against moisture. The module is formed on a transparent substrate upon which a sequence of patterned thin layers is deposited. The display generates over 100 fL brightness. A plurality of display modules may be tiled together, edge-to-edge, to form a large display panel. A method of making an electroluminescent display device is also disclosed in U.S. Pat. No. 4,614,668, in which there is provided a matrix of light-emitting elements in a row and column formation and adapted for excitation from the voltage supply which addresses the matrix. A plurality of light-emitting polymer phosphors are screen printed over the dielectric, with each phosphor corresponding to an individual light-emitting element. Voltage excitation by a dynamic voltage supply causes light emission by the light-emitting element at the excitation row-column intersection. While the aforementioned patents disclose thin-film electroluminescent display panels of the type that may be used in connection with the present invention, it is intended that any suitable electroluminescent display panel may be used as long as it performs the functions aforementioned. Preferably, the electroluminescent elements are paper thin lighting surfaces that are flexible and give off negligible heat. Such electroluminescent elements have been previously used in other applications because of their high visibility, such as safety products, backlighting and instrumentation panels, cellular phones, illuminated watches, membrane switch illumination and the like. This type of electroluminescent element is also used to provide backlighting in certain watches. As indicated, any such electroluminescent elements may be used which are solid state, use low power and provide a uniform light source. The elements should be thin, flexible, lightweight and moisture resistant. Since these electroluminescent elements come in various shapes, colors and sizes, it is clear that these specific parameters are not critical.

Figure 4:
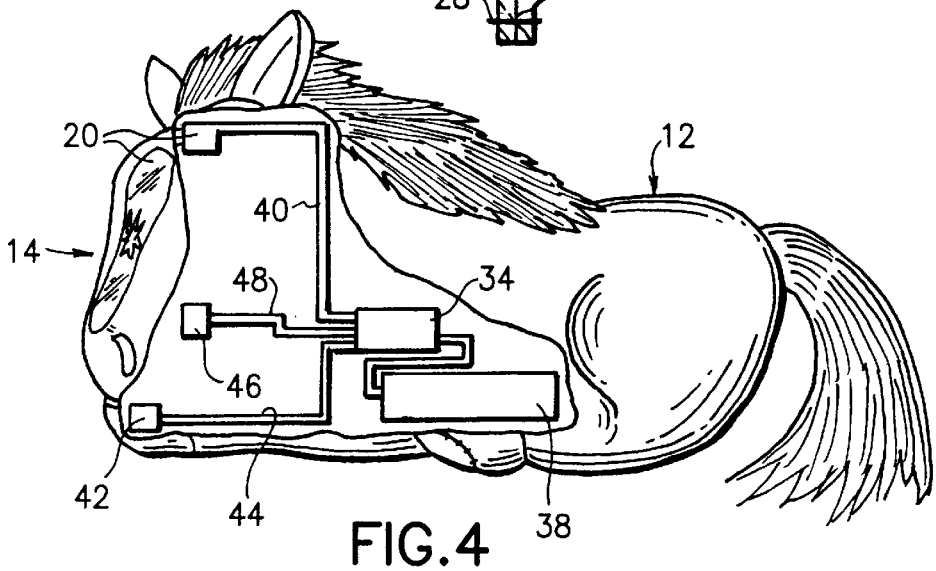
FIG. 4 is a side elevational view of the plush toy pony shown in FIG. 1, schematically illustrating the general locations of the electrical components which control the electroluminescent panel shown in FIGS. 1–3.

Referring to FIG. 4, the preferred embodiment of the invention houses, within the main body 12 thereof, electrical control circuitry 32 for selectively energizing the element 21. Preferably, such circuitry 32 also includes a timing circuit for maintaining the energized state of the electroluminescent element 21 for a predetermined period of time after the panel has been manually actuated. Referring to FIG. 4, a schematic representation of the electrical circuit 32 is shown, including a primary control module 34 which is connected by suitable conductors 36 to a battery case 38 which is housed within the body 12 and is accessible through a suitable opening in the body normally maintained closed by any suitable means, such as hook and loop fasteners sold under the brand VELCRO®. The battery case 38 contains batteries (not shown) of any suitable size for energizing the module 34. Also connected to the module 34 are two switches, an ON switch 42 connected to the module 34 by conductors 44 and situated within the right hoof 16' and an OFF switch 46 connected to the module 34 by conductors 48 and placed in the left hoof 18'. As indicated, the hooves 16', 18' are preferably soft and deformable so that a child can easily squeeze either hoof and actuate either of the two switches 42, 46. The switches may take any form and may be, for example, microswitches so positioned or arranged within the hooves so that the squeezing of either hoof will selectively close the associated switch. The IC module 34 is, of course, also connected by means of conductors 40 to the electroluminescent light element 41 in the region of the blaze 14' on the pony's face.

As suggested, the module 34 preferably includes a timing circuit so that once a child actuates the ON switch 42, the module will continue to power the electroluminescent element for a predetermined time period. In accordance with the presently preferred embodiment, such predetermined period is 30 minutes, although, clearly, this time may be changed as desired. The IC module 34 also functions to convert the DC power from the batteries in the battery case to a form suitable for energizing and activating the electroluminescent element 21. When such panel requires alternating current (AC), the module will include an inverter for making the necessary conversions from DC to AC. Of course, if the electroluminescent unit can be actuated by direct current (DC), then no such inverter is required, in which case the module 34 need simply convert the available voltage output from the battery box 38 to a suitable voltage level required by the electroluminescent element. The specific circuitry for energizing a given or specific electroluminescent panel is not critical for the purposes of the present invention and any such suitable circuitry may be used in accordance with principles well known in the art.

Figure 5:
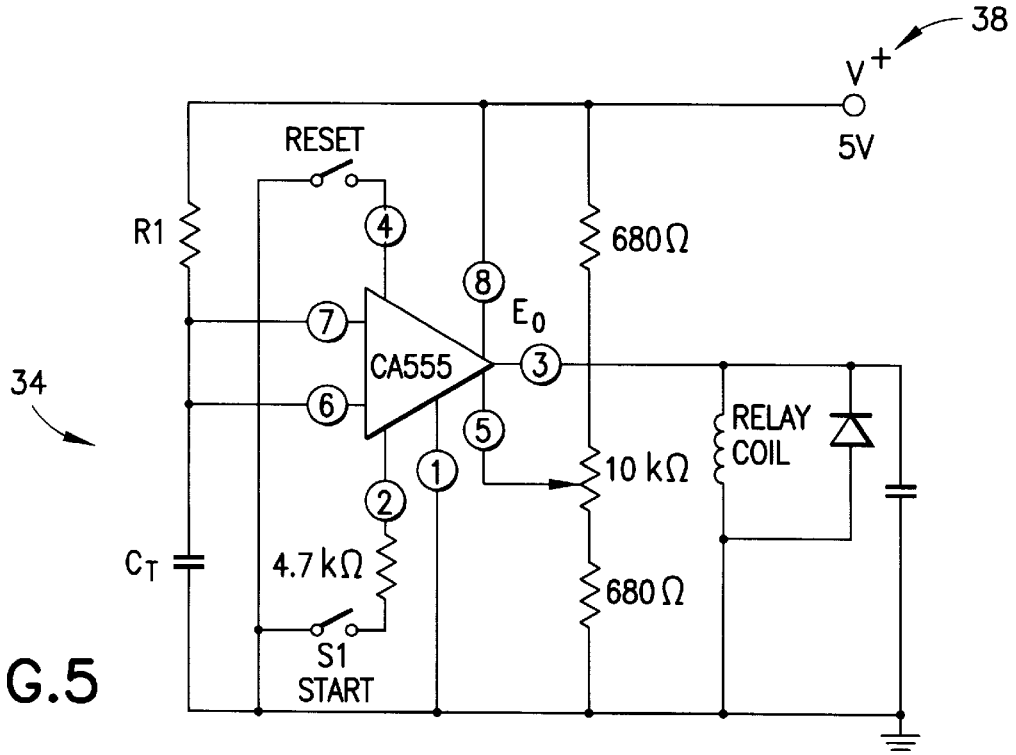
FIG. 5 is a schematic diagram illustrating one possible control circuit for controlling the illumination of the electroluminescent panel of FIGS. 1–4.

Referring to FIG. 5, an example is illustrated of a circuit that can be used to control the energization of the electroluminescent element 21, as well as control the duration of such energization. In this circuit, a reset timer circuit is used which is in the form of a mono stable multivibrator. The circuit is based on the RCA-CA 555 or CA 555C stable timers integrated circuits (IC) designed for use in precision timing and oscillator applications. Such integrated circuits are capable of producing accurate time delays for periods ranging from microseconds to hours. These devices are also useful for astable oscillator operation and can maintain an accurately controlled free-running frequency and duty cycle with only two external resistors and one capacitor. In the typical application shown in FIG. 5, the CA 555 IC is connected as a reset timer. In this mode of operation, capacitor $C_T$ is initially held discharged by a transistor on the integrated circuit. Upon closing of the "start" or "on" switch, S1 (switch 42 in FIG. 4), the integral timer flip-flop is "set" and releases the short circuit across capacitor $C_T$ which drives the output voltage "high" to apply a voltage across the load, in this instance, the electroluminescent element 21. The action allows the voltage across the capacitor to increase exponentially with the time constant $t=(R_1)(C_T)$. When the voltage across the capacitor equals two thirds of the source voltage $V^+$, the comparator resets the flip-flop, which in turn discharges the capacitor rapidly and reverts the output to its low state. Since the charge rate and threshold level of the comparator are both directly proportional to the supply voltage $V^+$, the timing interval is relatively independent of supply voltage variations. Closing of the reset switch connected to terminal 4 (switch 46 in FIG. 4) during the timing interval discharges $C_T$, but the timing cycle does not restart. Therefore, it is clear that this circuit may be used to actuate the electroluminescent element 21 after which the element will continue to be energized for a predetermined time period determined by the time constant of the RC elements. If desired, the element may be manually de-energized by simply pressing the "reset" or "off" switch.

Figure 6A:
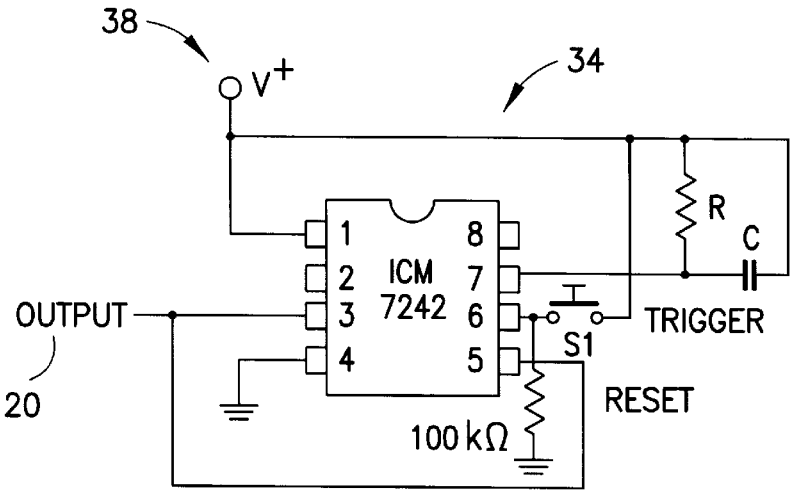
FIG. 6A is a schematic diagram of another control circuit for the electroluminescent panels.
Figure 6B:
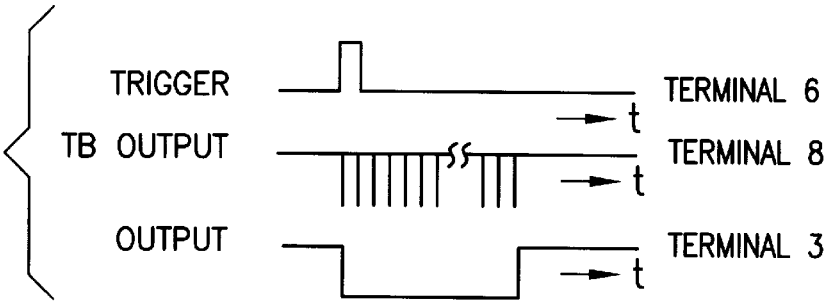
FIG. 6B shows three timing charts of electrical signals generated in circuit of FIG. 6A to explain the operation of the circuit.

Another example of a timer circuit that can be used is illustrated in FIG. 6A, this being based on the Intersil series of programmable timers ICM 7240/50/60. This timer IC has also been designed to provide timing functions from microseconds to days. FIG. 6B illustrates the timing sequence. When the switch $S_1$ (switch 42 in FIG. 4) is closed, this applies a trigger to terminal 6 of the IC. The IC commences to generate counting pulses illustrated at terminal 8. Concurrently with the generation of the trigger at terminal 6, an output voltage is generated at terminal 3, and that output voltage remains until a preselected number of pulses have been generated and counted by the circuit. While the circuit in FIG. 6A does not provide a separate reset switch, a reset switch may also be included at terminal 5. In the alternative, the "off" switch can be arranged to disconnect the voltage from the power source or power supply to the terminals 1 and 7. This will disable the IC, requiring it then to be triggered again in order to provide power at the output.

The circuits illustrated in FIGS. 5 and 6A are merely illustrative and numerous other circuits can clearly be used to perform or provide the same or similar functions in order to achieve the object of the present invention.

Although the present invention has been described in relation to particular embodiments thereof, many other variations, modifications and other uses will become apparent to those skilled in the art. It is the intention, therefore, that the present invention not be limited by the specific disclosure of the embodiments therein, but only by the scope of the appended claims.

What I claim is:

1. A plush toy including a main body and a head portion, a substantically flat electroluminescent display panel arranged on and forming a surface portion of said head portion; a power source arranged within said main body; and switch means accessible to a user for selectively applying and removing power to and from said power source to said electroluminescent display panel, whereby application of power to said electroluminescent panel energizes said panel and causes said panel to illuminate in the region of the toy.

2. A toy as defined in claim 1, wherein said body comprises a plush toy.

3. A toy as defined in claim 2, wherein said plush toy is in the form of a pony having hooves, said switching means being disposed within at least one of said hooves.

4. A toy as defined in claim 2, wherein said plush toy includes at lest one compressible portion and said switch means is disposed within said at least one compressible portion of said plush toy to allow actuation of said switch means by compressing/deforming said compressible portion.

5. A toy as defined in claim 1, further comprising control means responsive to said switch means for applying power to said electroluminescent element.

6. A toy as defined in claim 5, wherein said control means is disposed within said main body.

7. A toy as defined in claim 6, wherein said control means is powered by at least one battery housed within said main body.

8. A toy as defined in claim 5, wherein said control means is a timer integrated circuit (IC).

9. A toy as defined in claim 8, wherein said timer IC is a 555 IC.

10. A toy comprising a plush toy; an electroluminescent display panel arranged on and forming a surface portion of said main body; a power source arranged within said main body; and switch means accessible to a user for selectively applying and removing power to and from said power source to said electroluminescent display panel, whereby application of power to said electroluminescent panel energizes said panel and causes said panel to illuminate in the region of the toy, said plush toy being in the form of a horse having a blaze and said electroluminescent display panel is arranged on said blaze.

11. A toy as defined in claim 10, wherein said electroluminescent panel is substantially in the shape of said blaze.

12. A toy as defined in claim 11, wherein said electroluminescent unit is provided with means for generating a predetermined pattern of illumination when actuated.

13. A toy including a main body; a substantially flat electroluminescent display panel arranged on and forming a surface portion of said main body; a power source arranged within said main body; and switch means accessible to a user for selectively applying and removing power to and from said power source to said electroluminescent display panel, said electroluminescent panel being formed of a pouch having at least one transparent panel, said electroluminescent unit including one electroluminescent element within said pouch, to make said electroluminescent element visible through said pouch, whereby application of power to said electroluminescent panel energizes said panel and causes said panel to illuminate in the region of the toy.

14. A toy as defined in claim 13, wherein said at least one transparent panel is provided with printed indicia which becomes visible when said electroluminescent element is energized and serves as a background for said printed indicia.

15. A toy as defined in claim 14, wherein said printed indicia is silkscreened on said at least one transparent panel.

16. A toy as defined in claim 14, wherein said printed indicia comprises an aesthetic design which is opaque to selectively allow light generated by said electroluminescent element to pass through said at least one transparent panel to render the design visible.

17. A toy as defined in claim 14, wherein said printed indicia is selected from the group consisting of a star, a sunburst, a comet, a moonbeam, a cartoon character and a geometric pattern.

18. A plush toy including a main body and a head portion; a substantially flat elecroluminescent display panel arranged on and forming a surface portion of said head portion; a power source arranged within said main body; and switch means accessible to a user for selectively applying and removing power to and from said power source to said electroluminescent display panel, control means responsive to said switch means for applying power to said electroluminescent element, and including a timer for applying power to said electroluminescent element for a predetermined period of time, whereby application of power to said electroluminescent panel energizes said panel and causes said panel to illuminate in the region of the toy.

19. A toy as defined in claim 18, wherein said switch means comprises an "ON" switch for manually initiating control of said control means.

20. A toy as defined in claim 19, wherein said switch means comprises an "OFF" switch for manually terminating control of said control means.

* * * * *